US005912685A

United States Patent [19]

Raman

[11] Patent Number: 5,912,685

[45] Date of Patent: Jun. 15, 1999

[54] REDUCED CROSSTALK INKJET PRINTER PRINTHEAD

[75] Inventor: Gopalan Raman, Corvallis, Oreg.

[73] Assignee: Hewlett-Packard Company, Palo Alto, Calif.

[21] Appl. No.: 08/282,670

[22] Filed: Jul. 29, 1994

[51] Int. Cl.[6] ..... B41J 2/14; B41J 2/16

[52] U.S. Cl. ..... 347/65; 347/92; 347/94; 347/44; 347/56

[58] Field of Search ..... 347/65, 94, 56, 347/92, 44

[56] References Cited

U.S. PATENT DOCUMENTS

| | | | |
|---|---|---|---|
| 4,314,259 | 2/1982 | Cairns et al. | 346/75 |
| 4,502,060 | 2/1985 | Rankin et al. | 346/140 R |
| 4,528,577 | 7/1985 | Cloutier et al. | 346/140 R |
| 4,730,197 | 3/1988 | Raman et al. | 346/140 R |
| 4,794,410 | 12/1988 | Taub et al. | 346/140 R |
| 4,882,595 | 11/1989 | Trueba et al. | 346/140 R |
| 4,937,597 | 6/1990 | Yasuhara et al. | 346/140 R |
| 4,963,882 | 10/1990 | Hickman | 346/1.1 |
| 5,379,060 | 1/1995 | Yoshimura | 347/71 |
| 5,387,314 | 2/1995 | Baughman et al. | 156/643 |
| 5,463,413 | 10/1995 | Ho et al. | 347/65 |
| 5,608,436 | 3/1997 | Baughman et al. | 347/65 |

FOREIGN PATENT DOCUMENTS 0549211 6/1993 European Pat. Off. .

*Primary Examiner*—Huan H. Tran
*Attorney, Agent, or Firm*—Raymond A. Jenski

[57] ABSTRACT

High frequency of droplet ejection with minimized crosstalk and a uniform large ink droplet weight are realized in an inkjet printer printhead which employs two ink feed channels to couple an ink firing chamber to the source of ink. A first one of the ink feed channels has a lower fluid resistance to ink flowing in the channel than a second one of the ink feed channels. The first ink feed channel and the second ink feed channel each have an inlet to the ink source and are arranged such that the inlet of the first ink feed channel is closer to the ink firing chamber than the inlet of the second ink feed channel. Furthermore, adjacent ink firing chambers are arranged such that a lower fluid resistance ink channel of one ink firing chamber is next to a higher fluid resistance ink channel of a neighboring ink firing chamber. Nozzle diameter, heater resistor, and firing chamber dimensions are also optimized for the printhead.

18 Claims, 5 Drawing Sheets

REDUCED CROSSTALK INKJET PRINTER PRINTHEAD

BACKGROUND OF THE INVENTION

The present invention is generally related to a printhead for an inkjet printer and more particularly related to the design of ink feed channels for the ink firing chambers within the printhead to increase the speed of printing and reduce crosstalk. The present invention is related to U.S. patent application Ser. No. 08/282,243 for "Inkjet Printhead with Tuned Firing Chambers and Multiple Inlets" filed on behalf of Peter M. Burke et al. on the same date herewith.

Thermal inkjet printers operate by expelling a small volume of ink through a plurality of small nozzles or orifices in a surface held in proximity to a medium upon which marks or printing is to be placed. These nozzles are arranged in a fashion in the surface such that the expulsion of a droplet of ink from a determined number of nozzles relative to a particular position of the medium results in the production of a portion of a desired character or image. Controlled repositioning of the substrate or the medium and another expulsion of ink droplets continues the production of more pixels of the desired character or image. Inks of selected colors may be coupled to individual arrangements of nozzles so that selected firing of the orifices can produce a multicolored image by the inkjet printer.

Speed of printing (droplet ejection rate) and quality of print are essential to the user of an inkjet printer. Other factors such as spurious ink spray reduction and accurate positioning of the drop on the medium are also important.

Expulsion of the ink droplet in a conventional thermal inkjet printer is a result of rapid thermal heating of the ink to a temperature which exceeds the boiling point of the ink solvent and creates a vapor phase bubble of ink. Rapid heating of the ink is achieved by passing a square pulse of electric current through a resistor, typically for 1 to 3 microseconds. Each nozzle is coupled to a small unique ink firing chamber filled with ink and having the individually addressable heating element resistor thermally coupled to the ink. As the bubble nucleates and expands, it displaces a volume of ink which is forced out of the nozzle and deposited on the medium. The bubble then collapses and the displaced volume of ink is replenished from a larger ink reservoir by way of ink feed channels.

After the deactivation of the heater resistor and the expulsion of ink from the firing chamber, ink flows back into the firing chamber to fill the volume vacated by the ink which was expelled. It is desirable to have the ink refill the chamber as quickly as possible, thereby enabling very rapid firing of the nozzles of the printhead. Rapid firing of the nozzles, of course, results in high speed printing. When a drop is ejected from a printhead nozzle, some of the remaining fluid remains as an oscillating meniscus in the nozzle and replacement ink flows into the ink firing chamber to replenish ink lost to the ejected droplet. Before the next firing of the nozzle, the ink meniscus must come to rest and the ink must have sufficient time to refill the chamber, otherwise an undesirable variation in droplet weight will occur and the resultant printing will experience serious degradation of print density.

Since droplet weight must be of a predictable and uniform size for good quality printing, and because the droplet weight is generally related to the frequency at which the nozzles are fired, the printhead nozzle ejection frequency is limited. At high rates of droplet production, the time available for firing chamber refill is less. If the refill time is too short, a droplet of too low a droplet weight will be expelled in the next firing.

A large open fluid coupling between the supply of ink and the ink firing chamber would fulfill the need for high speed refilling. There are two issues for concern. First, the ink oscillation in the nozzle must be damped to minimize the variations in drop volume which will affect print quality. Second, in a practical printhead where a plurality of nozzles and firing chambers exist, such a large coupling would result not only in ink being forced from the nozzle which is being fired but also being forced via the ink feed supply route to neighboring ink firing chambers and their associated nozzles. This phenomenon is commonly referred to as crosstalk, and produces imprecisely defined characters in the printed output as a result of ink leaking from nozzles adjacent a fired nozzle and forming a puddle of ink on the external surface of the orifice plate. Thus, some form of buffering of the common ink source is necessary to prevent crosstalk between adjacent ink firing chambers. See, for example, U.S. Pat. No. 4,882,595.

It is generally accepted that good quality of graphic images require a printer resolution of 300 dpi or higher. As stated above, when one achieves high frequency of droplet ejection, one must also achieve droplets of sufficient volume to give good print quality. Smaller droplet weight results in degraded print quality. Droplet volume can also be increased by changing the resistor size or the nozzle size. These parameters in turn affect the refill rate, damping which limits the maximum frequency at which the printhead nozzle can operate. It follows, then, that in order to achieve desired droplet weight at high frequency, the ink feed channel dimensions, the orifice dimensions, and the heater resistor dimensions are critical.

It would be desirable, therefore, to realize an inkjet printhead having an increased print speed and sufficient uniform droplet weight with minimum crosstalk between neighboring ink firing chambers and nozzles.

SUMMARY OF THE INVENTION

A reduced crosstalk inkjet printer printhead apparatus and method has a source of ink, a plurality of ink firing chambers, and at least two ink feed channels coupling a first ink firing chamber to the source of ink. A first ink feed channel of the at least two ink feed channels is created having a first magnitude of fluid resistance presented to ink flowing in the first ink feed channel. A second ink feed channel of the at least two ink feed channels is created having a second magnitude of fluid resistance presented to ink flowing in the second ink feed channel. The second magnitude of fluid resistance is greater than the first magnitude of fluid resistance. The first ink feed channel and the second ink feed channel each have an inlet to the ink source.

DETAILED DESCRIPTION OF THE PREFERRED EMBODIMENTS

Large ink droplet weight and high frequencies of droplet ejection with minimized crosstalk are realized by a printhead employing the present invention. In a preferred embodiment, an island of barrier layer material is located near the entrance to the ink firing chamber. This island effectively provides more than one ink feed channel for introducing ink to the ink firing chamber. Having more than one ink feed channel decreases the time required for ink refill of the ink firing chamber and aids higher frequency of drop ejection with minimal change in droplet weight. Other printhead design parameters, such as nozzle diameter, barrier layer thickness, and heater resistor size are also optimized, in the preferred embodiment, to obtain a desired droplet weight with good damping.

Figure 1:
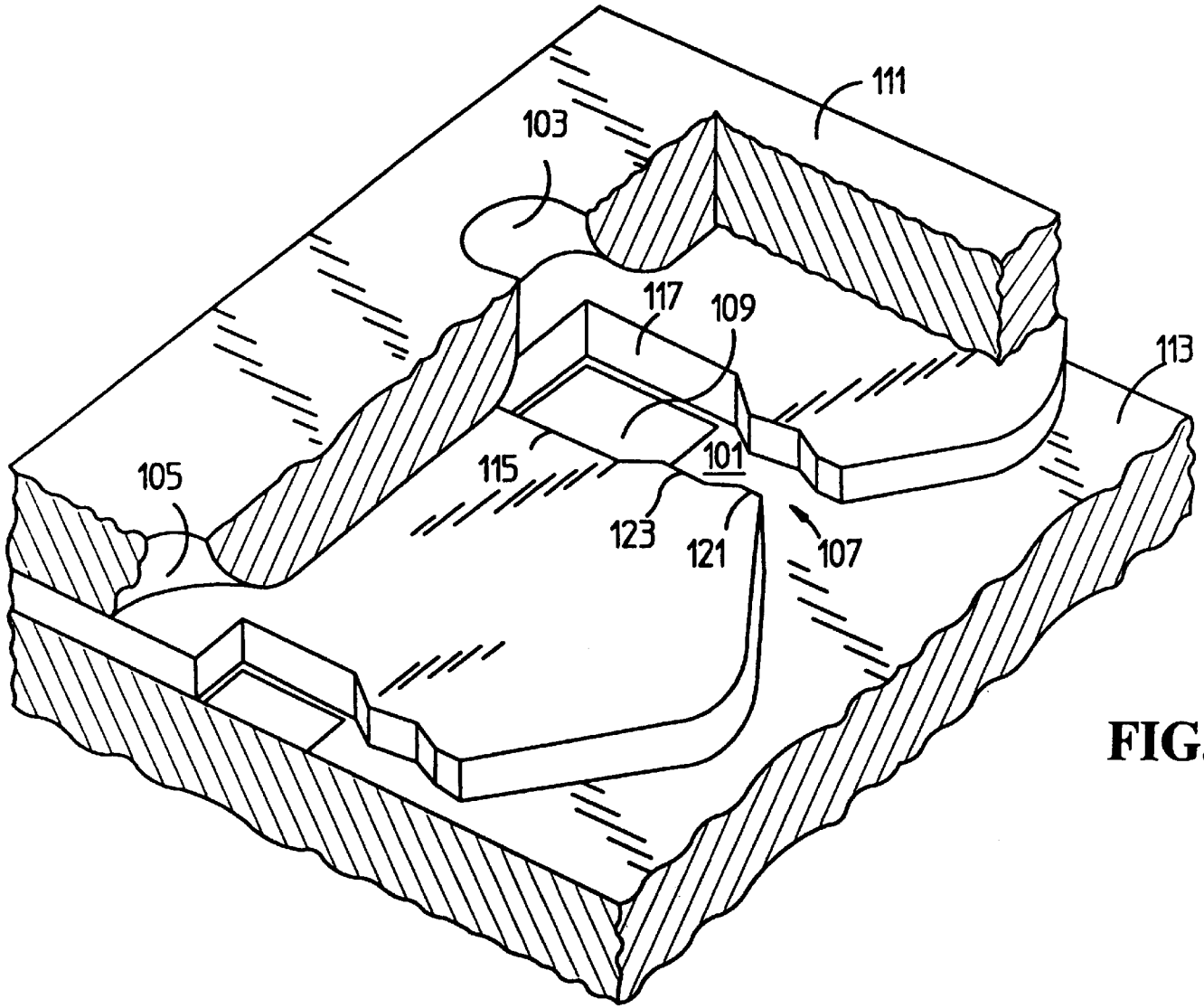
FIG. 1 is an isometric view of an inkjet printer printhead.

A greatly magnified isometric view of a portion of a typical thermal inkjet printhead for use in an inkjet printer is shown in FIG. 1. Several elements of the printhead have been sectioned to reveal an ink firing chamber 101 within the inkjet printhead. Many such firing chambers are typically arranged in a staggered row in the printhead and two such rows can be arranged in a group around an ink supply plenum for efficient and high quality printing. Additional groups may be located in the printhead to allow for individual colors to be printed from each group. Associated with each firing chamber 101 is a nozzle 103 disposed relative to the firing chamber 101 so that ink which is rapidly heated in the firing chamber by a heater resistor 109 is forcibly expelled as a droplet from the nozzle 103. Part of a second nozzle 105, associated with another ink firing chamber, is also shown. The heater resistors are selected by a microprocessor and associated circuitry in the printer in a pattern related to the data entered into the printer so that ink which is expelled from selected nozzles creates a defined character or figure of print on the medium. The medium (not shown) is typically held parallel to the orifice plate 111 and perpendicular to the direction of the ink droplet expelled from the nozzle 103. Ink is supplied to the firing chamber 101 via an opening 107 commonly called an ink feed channel. This ink is supplied to the ink feed channel 107 from a much larger ink reservoir (not shown) by way of an ink plenum formed by the space between the orifice plate and the substrate, external to the firing chambers, and common to all firing chambers in a group.

Once the ink is in the firing chamber 101 it remains there until it is rapidly heated to boiling by the heater resistor 109. Conventionally, the heater resistor 109 is a thin film resistance structure disposed on the surface of a silicon substrate 113 and connected to electronic circuitry of the printer by way of conductors disposed on the substrate 113. Printheads having increased complexity typically have some portion of the electronic circuitry constructed in integrated circuit form on the silicon substrate 113. Various layers of protection such as passivation layers and cavitation barrier layers may further cover the heater resistor 109 to protect it from corrosive and abrasive characteristics of the ink. Thus, the ink firing chamber 101 is bounded on one side by the silicon substrate 113 with its heater resistor 109 and other layers, and bounded on the other side by the orifice plate 111 with its attendant orifice 103. The other sides of the firing chamber 101 and the ink feed channel 107 are defined by a polymer barrier layer 115. This barrier layer is preferably made of an organic polymer plastic which is substantially inert to the corrosive action of ink and is conventionally deposited upon substrate 113 and its various protective layers and is subsequently photolithographically defined into desired geometric shapes and etched. Polymers suitable for the purpose of forming a barrier layer 115 include products sold under the names Parad, Vacrel, and Riston by E. I. DuPont De Nemours and Company of Wilmington, Del. Such materials can withstand temperatures as high as 300 degrees C. and have good adhesive properties for holding the orifice plate of the printhead in position.

The orifice plate 111 is secured to the silicon substrate 113 by the barrier layer 115. Typically the orifice plate 111 is constructed of nickel, or similar material, with a plating of gold to resist the corrosive effects of the ink. In order to damp the flow of ink back toward the ink source, the ink feed channel 107 has been given a series of constrictions 121 and 123 of decreasing channel width and dependent upon the distance from the heater resistor 109. Such a configuration has been found to provide satisfactory isolation and diminished crosstalk but at the cost of firing chamber ink refill speed.

Figure 2:
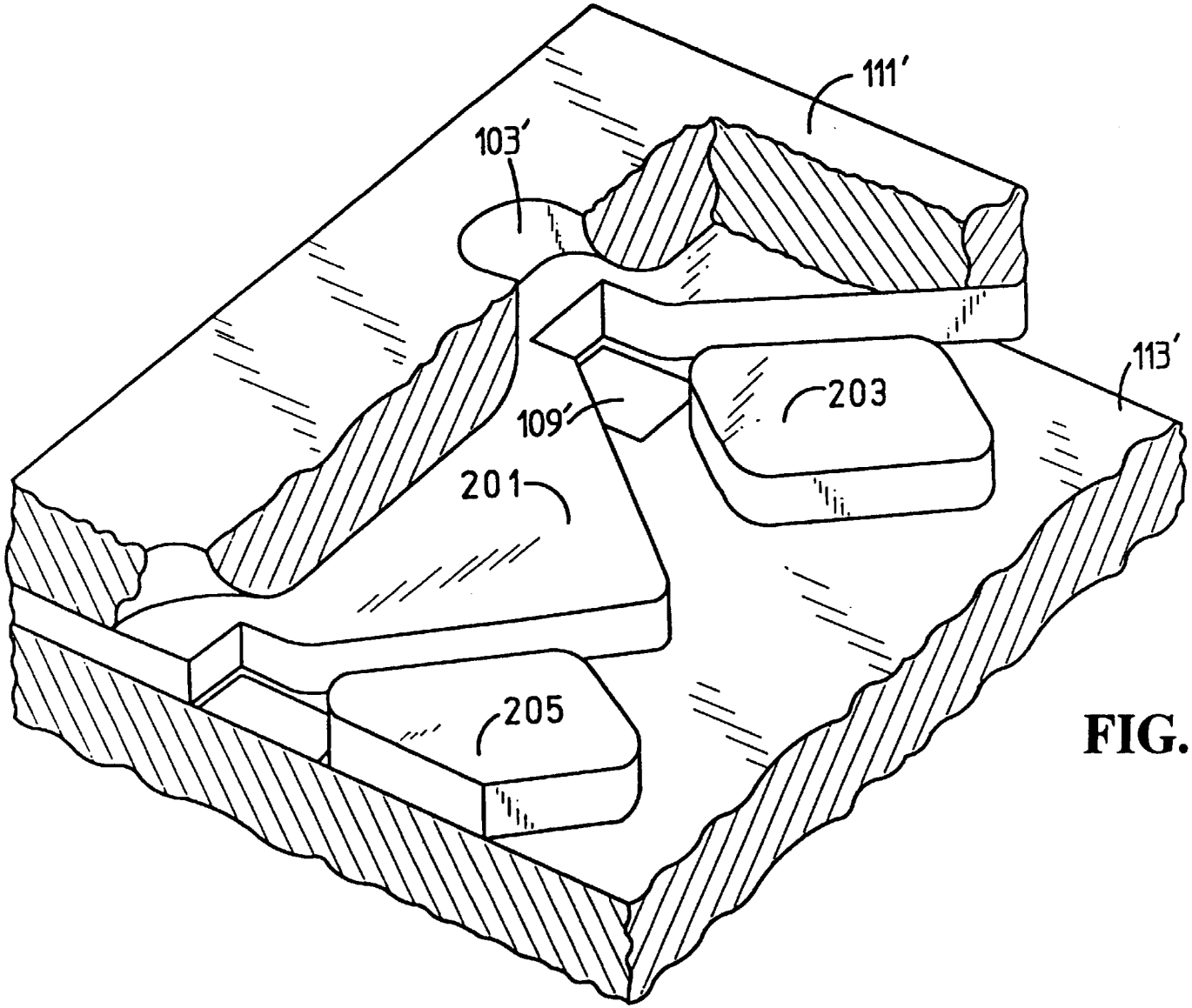
FIG. 2 is an isometric view of an inkjet printer printhead which may employ the present invention.

In order to realize an increased print speed, the barrier material configuration for the ink feed channels has been configured in accordance with the present invention. An isometric view of a preferred embodiment is shown in FIG. 2. A layer of polymer barrier material 201 is conventionally deposited upon the silicon substrate 113'. As part of the polymer material etching process, a series of barrier material islands 203, 205 are created upon the silicon substrate 113'. (Resistor 109' is conventionally created from thin film resistance material on the silicon substrate 113'). In the preferred embodiment, the heater resistors are offset from one another and deviate from a straight line column to conventionally account for timing logic and common interconnection.

Figure 3:
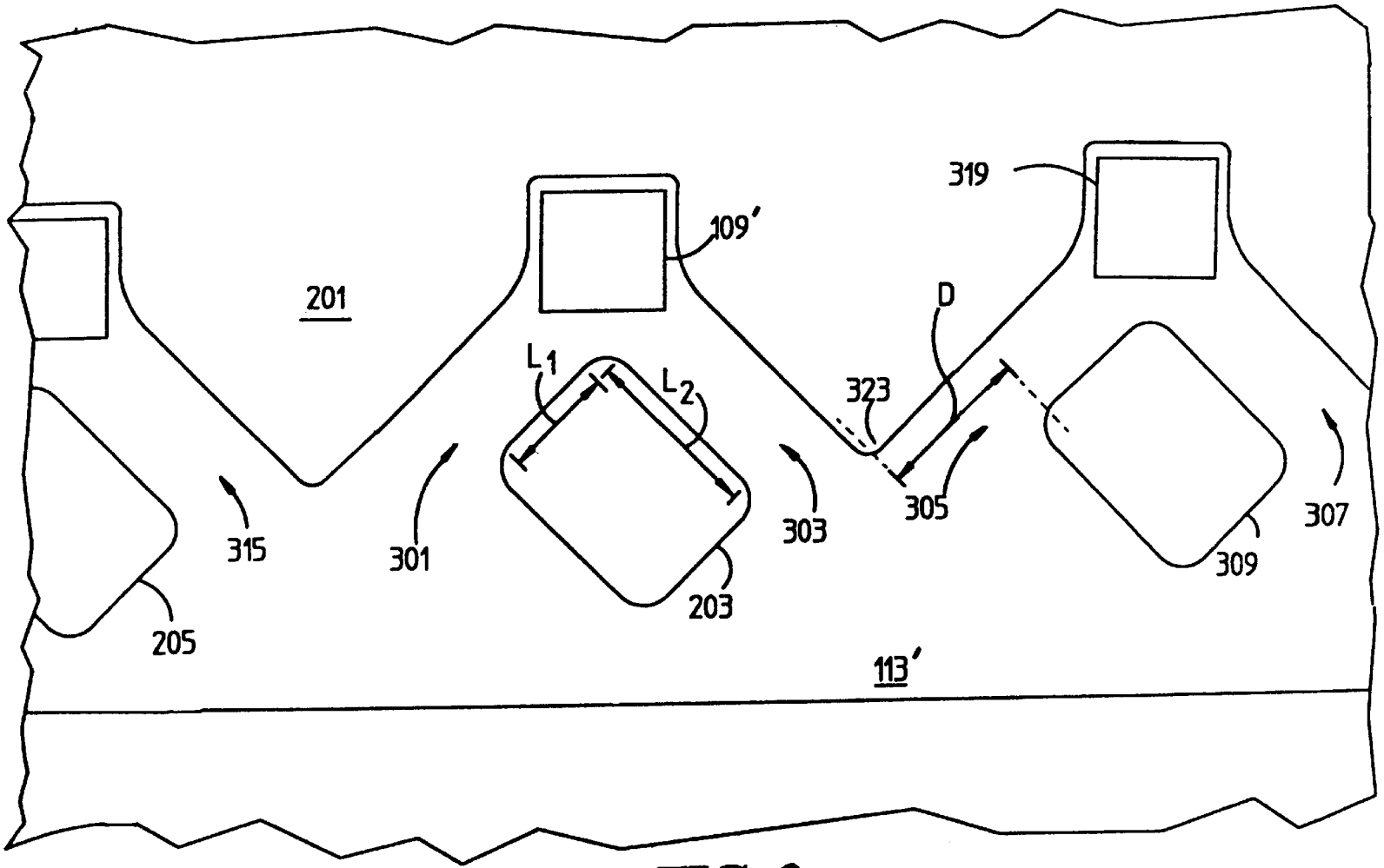
FIG. 3 is a planar view of the barrier layer and substrate of a printhead which may employ the present invention.
Figure 4:
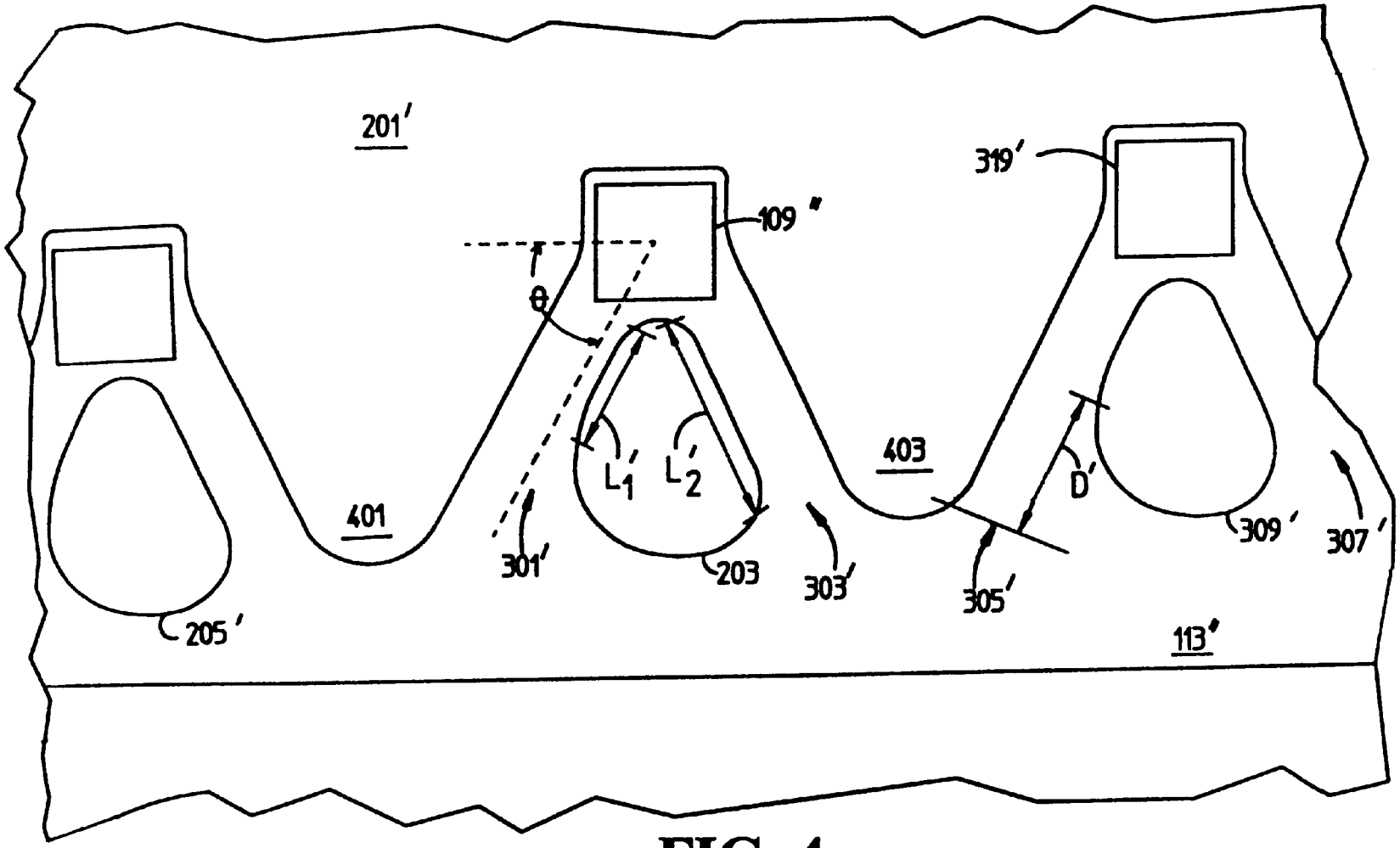
FIG. 4 is a planar view of a barrier layer and substrate of an alternative design of a printhead which may employ the present invention.

The barrier material islands 203, 205 are disposed between the heater resistors and the source of ink as shown in FIG. 3, the plan view of the barrier layer of the printhead of FIG. 2. While a particular island configuration is shown in the preferred embodiment, other configurations may be employed as well. For example, an alternative embodiment is shown in FIG. 4. Referring again to FIG. 3, this configuration effectively creates two ink channels, for example ink channels 301 and 303 associated with barrier material island 203 and ink channels 305 and 307 associated with barrier material island 203. Such an arrangement of two ink channels provides both a redundancy of ink feed and a large effective aperture to the ink plenum for rapid refilling of the ink firing chamber around heater resistor 109'.

When electrical energy is applied to the heater resistor 109', an ink vapor bubble is formed in the ink firing chamber above the heater resistor 109'. The rapid formation of this ink vapor bubble, in addition to ejecting ink through the nozzle 103', also forces ink backwards into the ink feed channels 301 and 303. Ink flowing in this backwards direction is forced out into the ink plenum and into the ink feed channels of neighboring ink firing chambers. For example, nucleation of an ink vapor bubble over heater resistor 109' not only expels ink from the nozzle in the orifice plate but also backwards down ink feed channels 301 and 303. The pulse of ink enters the ink plenum and also enters the ink feed channels of neighboring firing chambers via ink feed channel 305 and 315. As a result of this ink pulse; the meniscus which normally forms at the nozzle opening is forced beyond the rim of the nozzle and spills out onto the outer surface of the orifice plate. Such a spill leaves a puddle of ink on the outer surface which attaches itself to a droplet expelled from the orifice at a later time and both adversely affects the trajectory of the droplet and generates a spurious spray of ink resulting in a poorer quality of printed images and characters. It is an important feature of the present invention that the ink pulse which emanates from the ink feed channels of an ink firing chamber is prevented from causing ink in neighboring firing chambers from spilling onto the surface of the orifice plate.

As indicated in FIG. 3, the fluid resistance presented to ink in each of the two ink feed channels associated with a given one ink firing chamber is asymmetrical. Ink feed channel 301, in the present invention, is created from the barrier material with a channel length having a range of between 40 and 44 micrometers. In the preferred embodiment, $L_1$=44 micrometers. The second ink feed channel 303 supplying the ink firing chamber containing heater resistor 109' has a length having a range of between 58 and 62 micrometers. In the preferred embodiment, $L_2$=62 micrometers. This differential in channel length provides a relatively low magnitude of fluid resistance in ink feed channel 301 and a relatively high magnitude of fluid resistance in ink feed channel 303. The absolute value of fluid resistances are proportional to the channel lengths of the ink feed channels. Of importance to the present invention is the relation between the magnitudes of the fluid resistances. In the preferred embodiment, ink feed channel 303 has a magnitude of fluid resistance 41% greater than the fluid resistance magnitude of ink feed channel 301. Of course, one may vary this asymmetry of fluid resistance when practicing the present invention. Ink returns to refill the ink firing chamber more quickly via ink feed channel 301 and is augmented by ink returning more slowly via ink feed channel 303. The speed of printing is thus established, in the preferred embodiment, by the time required to refill the ink firing chamber to an ink volume sufficient to produce an expelled ink droplet of a predetermined weight (for example in the preferred embodiment a droplet weight of 89.3 ng.). It is also an important feature of the present invention that adjacent firing chambers be arranged relative to each other such that an ink feed channel of one ink firing chamber having a relatively low fluid resistance be directly adjacent the ink feed channel of the neighboring ink firing chamber having a relatively high fluid resistance. This arrangement is visible in the plan view of FIG. 3. The ink firing chamber associated with heater resistor 109' is adjacent the ink firing chamber associated with heater resistor 319. Ink feed channel 305 has a shorter channel length and therefore a lower fluid resistance. This ink feed channel is placed directly adjacent the high fluid resistance ink feed channel 303. The ink pulse emanating from ink feed channel 303, therefore, is attenuated more than that emanating from ink feed channel 301. Thus, the pulse available at the entrance to the low fluid resistance ink feed channel 305 is smaller than would otherwise be expected in the absence of the present invention. Reciprocally, an ink pulse emanating from ink feed channel 305, having a relatively higher magnitude due to the lower fluid resistance of ink feed channel 305, appears at the inlet of adjacent ink feed channel 303 which has a higher fluid resistance. The ink pulse is thereby attenuated by the higher fluid resistance channel 303.

It is also a feature of the present invention that the lower fluid resistance ink feed channel open more directly into the ink plenum than the higher fluid resistance ink feed channel. Again referring to FIG. 3, it can be seen that the inlet to the ink feed channel 305, due to its shorter channel length, reaches the ink plenum (and its large ink mass) well before the inlet opening of the neighboring ink feed channel 303. The firing chamber fed by the ink feed channel 305 is effectively closer to the ink plenum than the firing chamber fed by ink channel 303. In the preferred embodiment, a protrusion 323 of barrier material which separates the two neighboring ink firing chambers separates the inlet opening of lower fluid resistance ink feed channel 305 from the inlet opening of higher fluid resistance ink feed channel 303 by a distance D=22 micrometers in the preferred embodiment. This ink feed channel offset allows much of the ink pulse emanating from the lower fluid resistance ink feed channel to be absorbed by the ink mass within the ink plenum rather than being propagated through the neighboring ink feed channel.

Optimum performance of a printhead occurs at a point where the parameters of nozzle diameter, resistor size, and channel dimensions are optimized relative to each other. The parameters of the preferred embodiment are shown in Table 1. Further, higher frequencies are achieved in printheads having a center feed ink slot (not shown) by having a short shelf length (the distance from the ink slot to the tip of the barrier material projection). In the preferred embodiment, the shelf length is approximately 25 micrometers. Also, in order to attain droplet uniformity, the ink is preferably prewarmed to approximately 40° C. to realize a constant ink viscosity under different ambient conditions.

TABLE 1

| | Range (μmeter) | Preferred (μmeter) |
|---|---|---|
| Resistor (square) | 42–45 | 44 |
| Channel width | 26–34 | 30 |
| Chamber (square) | 52–55 | 54 |
| Barrier thickness | 19–30 | 25 |
| Orifice diameter | 40–44 | 42 |
| Orifice length | 53–55 | 54 |

An alternative embodiment of the present invention is shown in the plan view of the barrier layer and substrate of FIG. 4. The barrier layer 201' is conventionally layered over the substrate 113" and subsequently etched to form the barrier layer islands 203', 205', and 309' in addition to the ink firing chambers and barrier layer protrusions 401 and 403 between the illustrated ink firing chambers. In the alternative embodiment, the barrier islands are essentially teardrop shaped with the tail of the teardrop facing the heater resistors. The ink feed channels formed by the barrier island 203'(301' and 303') have different channel lengths as described previously, in order to obtain an asymmetrical fluid resistance magnitude between the ink feed channels. For ink feed channel 301', the channel length ranges between 40 and 44 micrometers ($L_1'$=44 micrometers, in the alternative embodiment) and for ink feed channel 303', the channel length ranges between 58 and 62 micrometers (L2'=62 micrometers, in the preferred embodiment). The shorter channel length of ink feed channel 301' in combination with the barrier island shape of the alternative embodiment, 203', results in the pulse of ink resulting from the ink firing occurrence in the firing chamber reaching the mass of ink in the ink plenum sooner than the ink pulse emanating from ink feed channel 303'. As in the preferred embodiment discussed in relation to FIG. 3, the arrangement of ink feed channels and ink firing chambers provides crosstalk protection for adjacent ink firing chambers. The inlet to the ink feed channels having the lower magnitude of fluid resistance is thus closer to the firing chamber by a distance D'=22 micrometers, in the alternative embodiment. It should be observed that the ink feed channels approach the ink feed channel at a steeper angle (relative to a line parallel to a back wall of the ink feed chamber) in the alternative embodiment than in the preferred embodiment. In the alternative embodiment Θ=60° (while a similar angle in the preferred embodiment is 45°). The heater resistors 109" and 319' and ink feed channels 305' and 307' operate in the alternative design in the same manner as in the preferred embodiment.

Figure 5:
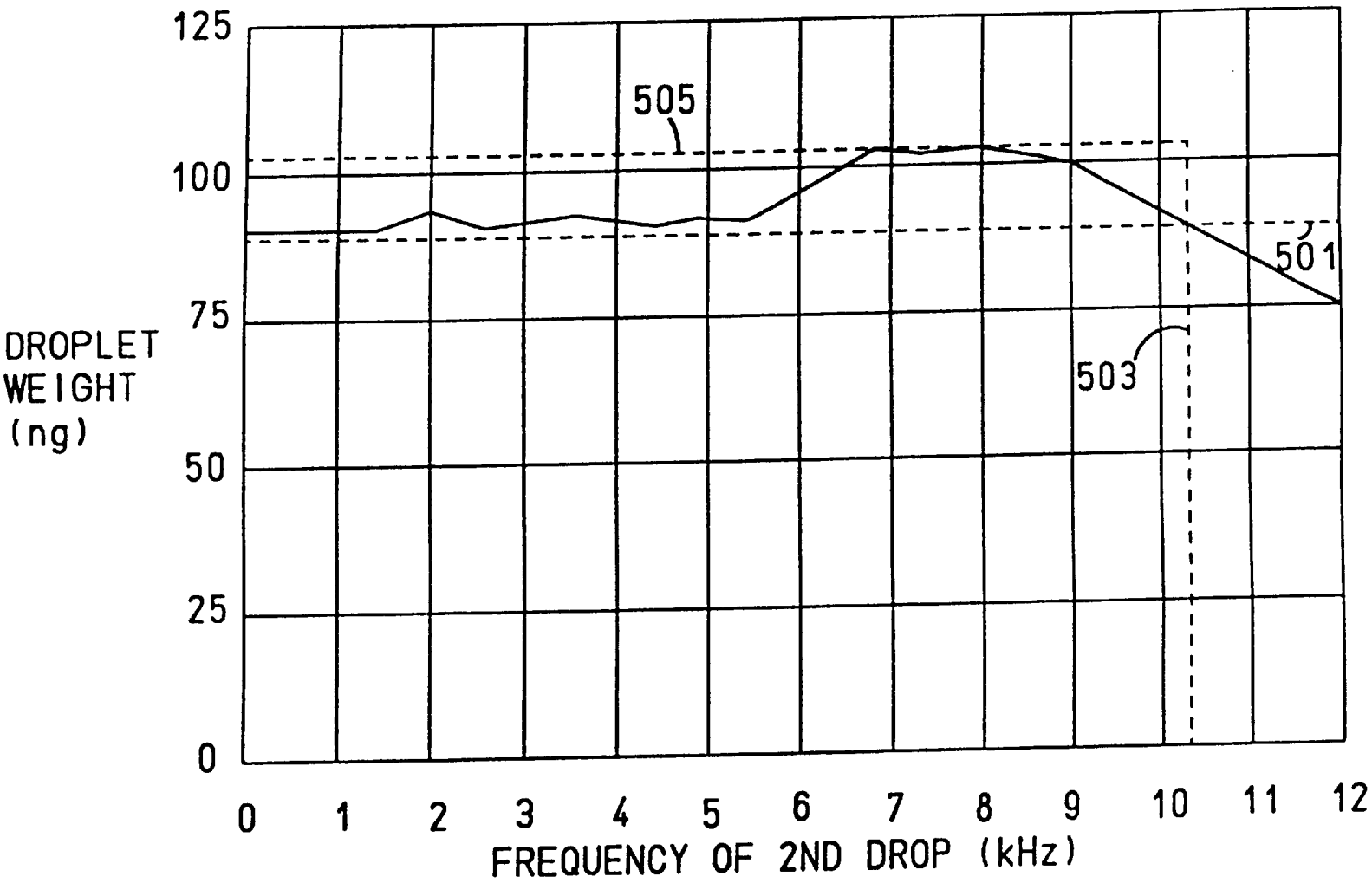
FIG. 5 is a graph of ink drop weight versus the frequency of printhead nozzle expulsions for the second drop, and related to the present invention.

The performance improvement of a printhead employing the present invention can be perceived from the graph of FIG. 5. In FIG. 5, the weight of the second ink droplet which is emitted from the nozzle during a print cycle is plotted against the droplet production rate (frequency at which the printhead nozzles are fired). When a printer printhead employing the present invention is operated with a minimum allowable droplet weight of 89.3 ng, the rate at which nozzle firings occur is 10.3 KHz (note the intersection of the broken lines 501 and 503). In the preferred embodiment, the electrical pulse width applied to the heater resistors is 2.4 microseconds to deliver a total energy of 8.6 microJoules. Of particular interest is the fact that the present invention supports an essentially constant droplet volume across the droplet production frequencies. Consider the situation in which a particular nozzle is called upon to eject a droplet, not eject a droplet in the next print cycle, and then eject a droplet. The effective frequency of droplet production for that particular nozzle is one-half the maximum frequency, that is, 5.15 KHz. The weight of the droplet expelled at 10.3 KHz is essentially the same as the droplet expelled at 5.15 KHz. The largest droplet weight (101.7 ng. in the preferred embodiment) is reached between 7 and 8 KHz (see broken line 505), but this frequency of droplet production is not used during operation of the printhead of the preferred embodiment. Thus, a printhead employing the present invention achieves a uniform high droplet weight, typically 75 to 95 ng, and high frequencies of drop ejection, 9 to 12 KHz, while retaining an excellent print quality.

I claim:

1. A reduced crosstalk inkjet printer printhead having a source of ink and a plurality of ink firing chambers, comprising:

at least two ink feed channels coupling only a first ink firing chamber of the plurality of ink firing chambers to the source of ink;

a first ink feed channel of said at least two ink feed channels having a first magnitude of fluid resistance presented to ink flowing in said first ink feed channel, and said first ink feed channel having an inlet to the ink source; and a second ink feed channel of said at least two ink feed channels having a second magnitude of fluid resistance, greater than said first magnitude of fluid resistance, presented to ink flowing in said second ink feed channel, and said second ink feed channel having an inlet to the ink source.

2. A reduced crosstalk inkjet printer printhead in accordance with claim 1 further comprising said first ink feed channel inlet disposed closer to said first ink firing chamber than said second ink feed channel inlet.

3. A reduced crosstalk inkjet printer printhead in accordance with claim 1 further comprising said second ink feed channel having a longer channel length than said first ink feed channel thereby creating said second magnitude of fluid resistance greater than said first magnitude of fluid resistance.

4. A reduced crosstalk inkjet printer printhead in accordance with claim 1 further comprising a second ink firing chamber of the plurality of ink firing chambers having third and fourth ink feed channels coupling only said second ink firing chamber to the source of ink, said third ink feed channel having said first magnitude of fluid resistance presented to ink flowing in said third ink feed channel and said fourth ink feed channel having said second magnitude of fluid resistance presented to ink flowing in said fourth ink feed channel, and said second ink firing chamber disposed adjacent said first ink firing chamber with said third ink feed channel disposed adjacent said second ink feed channel.

5. A reduced crosstalk inkjet printer printhead in accordance with claim 3 wherein said first and second ink feed channels include said first ink feed channel having a length of between 40 and 44 micrometers and said second ink feed channel having a length of between 58 and 62 micrometers and both ink feed channels having a channel width of between 26 and 34 micrometers.

6. A reduced crosstalk inkjet printer printhead in accordance with claim 1 wherein said first ink firing chamber includes an essentially square dimension of between 52 and 55 micrometers, a heater resistor having an essentially square configuration of between 42 and 45 micrometers, and an orifice having an essentially cylindrical configuration with a diameter of between 40 and 44 micrometers and a length of between 53 and 55 micrometers, whereby a droplet ejection frequency of between 9 and 12 Khz is achieved for droplets exceeding 75 nanograms in weight.

7. A reduced crosstalk inkjet printer printhead having a source of ink and a plurality of ink firing chambers, comprising:

a first ink firing chamber and a second ink firing chamber of the plurality of ink firing chambers, said first ink firing chamber coupled to the source of ink only by first and second ink feed channels and second ink firing chamber coupled to the source of ink only by third and fourth ink feed channels;

said first and third ink feed channels having a first channel length and respective inlets to the source of ink;

said second and fourth ink feed channels having a second channel length and respective inlets to the source of ink; and said first and second ink firing chambers disposed adjacent each other with said second ink feed channel inlet and said third ink feed channel inlet disposed adjacent each other.

8. A reduced crosstalk inkjet printer printhead in accordance with claim 7 further comprising:

said first and third ink feed channels having a first magnitude of fluid resistance;

said second and fourth ink feed channels having a second magnitude of fluid resistance; and said second magnitude of fluid resistance established greater than said first magnitude of fluid resistance.

9. A method of reducing crosstalk in an inkjet printer printhead having a source of ink and a plurality of ink firing chambers, the method comprising the steps of:

coupling at least two ink feed channels only between a first ink firing chamber of the plurality of ink firing chambers and the source of ink;

creating a first ink feed channel of said at least two ink feed channels having an inlet to the ink source and having a first magnitude of fluid resistance presented to ink flowing in said first ink feed channel; and creating a second ink feed channel of said at least two ink feed channels having an inlet to the ink source and having a second magnitude of fluid resistance, greater than said first magnitude of fluid resistance, presented to ink flowing in said second ink feed channel.

10. A method in accordance with the method of claim 9 further comprising the step of disposing said first ink feed channel inlet closer to said first ink firing chamber than said second ink feed channel inlet.

11. A method in accordance with the method of claim 9 wherein said steps of creating said first ink feed channel and said second ink feed channel further comprises the step of creating said second ink feed channel with a longer channel length than said first ink feed channel such that said second magnitude of fluid resistance greater than said first magnitude of fluid resistance.

12. A method in accordance with the method of claim 9 further comprising the steps of:

coupling at least two ink feed channels only between a second ink firing chamber of the plurality of ink firing chambers and the source of ink;

creating a third and fourth ink feed channels coupling said second ink firing chamber only to the source of ink, said third ink feed channel having said first magnitude of fluid resistance presented to ink flowing in said third ink feed channel and said fourth ink feed channel having said second magnitude of fluid resistance presented to ink flowing in said fourth ink feed channel; and disposing said second ink firing chamber adjacent said first ink firing chamber with said third ink feed channel disposed adjacent said second ink feed channel.

13. A method of constructing a reduced crosstalk inkjet printer printhead by creating a plurality of ink firing chambers from a barrier layer disposed between a substrate and an orifice plate, comprising the steps of:

creating at least two ink feed channels from the barrier layer, the substrate, and the orifice plate, said at least two ink feed channels only coupling a first ink firing chamber of the plurality of ink firing chambers to a source of ink;

creating a first ink feed channel of said at least two ink feed channels having an inlet to the ink source and having a first magnitude of fluid resistance presented to ink flowing in said first ink feed channel; and creating a second ink feed channel of said at least two ink feed channels having an inlet to the ink source and having a second magnitude of fluid resistance, greater than said first magnitude of fluid resistance, presented to ink flowing in said second ink feed channel.

14. A method in accordance with the method of claim 13 further comprising the step of disposing said first ink feed channel inlet closer to said first ink firing chamber than said second ink feed channel inlet.

15. A method in accordance with the method of claim 13 wherein said steps of creating said first ink feed channel and said second ink feed channel further comprises the step of creating said second ink feed channel with a longer channel length than said first ink feed channel such that said second magnitude of fluid resistance greater than said first magnitude of fluid resistance.

16. A method in accordance with the method of claim 13 further comprising the steps of:

creating a third and fourth ink feed channel from the barrier layer, the substrate, and the orifice plate, said third and fourth ink feed channels only coupling a second ink firing chamber of the plurality of ink firing chambers to said source of ink;

creating said third ink feed channel having said first magnitude of fluid resistance presented to ink flowing in said third ink feed channel;

creating said fourth ink feed channel having said second magnitude of fluid resistance presented to ink flowing in said fourth ink feed channel; and disposing said second ink firing chamber adjacent said first ink firing chamber with said third ink feed channel disposed adjacent said second ink feed channel.

17. A method of constructing a reduced crosstalk inkjet printer printhead by creating a plurality of ink firing chambers from a barrier layer disposed between a substrate and an orifice plate, comprising the steps of:

creating a first ink firing chamber and a second ink firing chamber of the plurality of ink firing chambers from the barrier layer, the substrate, and the orifice plate;

coupling said first ink firing chamber to a source of ink only by first and second ink feed channels, and coupling second ink firing chamber to said source of ink only by third and fourth ink feed channels;

creating said first and third ink feed channels having a first channel length and respective inlets to the source of ink;

creating said second and fourth ink feed channels having a second channel length and respective inlets to the source of ink; and disposing said first and second ink firing chambers adjacent each other with said second ink feed channel inlet and said third ink feed channel inlet disposed adjacent each other.

18. A method in accordance with the method of claim 17 further comprising the steps of:

creating said first and third ink feed channels having a first magnitude of fluid resistance;

creating said second and fourth ink feed channels having a second magnitude of fluid resistance; and establishing said second magnitude of fluid resistance greater than said first magnitude of fluid resistance.

* * * * *